US008875878B2

(12) United States Patent
Young

(10) Patent No.: US 8,875,878 B2
(45) Date of Patent: Nov. 4, 2014

(54) PACKAGE FOR SMOKING ARTICLES WITH LID FLAP

(75) Inventor: Richard Young, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 14/001,477

(22) PCT Filed: Jan. 31, 2012

(86) PCT No.: PCT/GB2012/050196

§ 371 (c)(1),
(2), (4) Date: Sep. 10, 2013

(87) PCT Pub. No.: WO2012/114082

PCT Pub. Date: Aug. 30, 2012

(65) Prior Publication Data

US 2013/0341219 A1 Dec. 26, 2013

(30) Foreign Application Priority Data

Feb. 23, 2011 (GB) ..... 1103091.3

(51) Int. Cl.

| | |
|---|---|
| ***B65D 85/10*** | (2006.01) |
| ***B65D 5/42*** | (2006.01) |
| ***A24F 15/12*** | (2006.01) |
| ***B65D 5/66*** | (2006.01) |

(52) U.S. Cl.

CPC ..... *A24F 15/12* (2013.01); *B65D 85/1045* (2013.01); *B65D 5/6691* (2013.01)

USPC ..... 206/268; 229/146; 229/160.1

(58) Field of Classification Search

CPC ..... B65D 5/6691; B65D 81/1045; B65D 81/1054

USPC ..... 206/268, 271, 273; 229/146, 148, 160.1

See application file for complete search history.

(56) References Cited

U.S. PATENT DOCUMENTS 4,948,038 A * 8/1990 Moeller ..... 229/146
5,314,114 A * 5/1994 Stone ..... 229/160.1

(Continued)

FOREIGN PATENT DOCUMENTS

DE 19644759 A1 4/1998
EP 0841263 A1 5/1998

(Continued)

OTHER PUBLICATIONS

International Search Report and Written Opinion, mailed Apr. 2, 2012 for International Application No. PCT/GB2012/050196, filed Jan. 31, 2012.

*Primary Examiner* — Bryon Gehman
(74) *Attorney, Agent, or Firm* — N W Poulsen; L A Pinol

(57) ABSTRACT

The present invention relates to a package for smoking articles comprising a container portion (2) and a lid (3). The lid is hingedly connected to the container 5 portion (2) to enclose a space defined by the container portion (2) when the lid (3) is closed. The lid (3) includes an end portion (16) and a wall (12) extending from the end portion (16) that overlaps a wall (6) of the container portion (2) when closed. A flap (26,93,107,120) extends from a face of one of said walls having a free end (29,96,109,125), and a cut-out (51,80,102) is formed in the other of said walls, 10 wherein one of the cut-out (51,80) or the free end (109,125) of the flap (107,120) has a first edge (54,65,73,87,115,127) and a second edge (55,56,66,74,88,90,116,128). The first edge is offset from the second edge such that, when the lid (3) is moved to a closed position, said first edge locates over the free end (29,96) of the flap (26,93) or the cut-out (102) before the second edge locates over the free end of the flap or 15 the cut-out.

21 Claims, 9 Drawing Sheets

(56) References Cited

U.S. PATENT DOCUMENTS

| | | | | |
|---|---|---|---|---|
| 5,875,960 | A * | 3/1999 | Nanno | 229/146 |
| 5,896,984 | A * | 4/1999 | Focke et al. | 206/268 |
| 6,105,856 | A * | 8/2000 | Kakiuchi | 229/148 |
| 6,334,532 | B1 * | 1/2002 | Tambo et al. | 206/268 |
| 6,719,131 | B1 * | 4/2004 | Focke et al. | 206/268 |
| 8,567,598 | B2 * | 10/2013 | Gibson | 206/268 |
| 2008/0230410 | A1 * | 9/2008 | Jones et al. | 206/268 |

FOREIGN PATENT DOCUMENTS

| | | | |
|---|---|---|---|
| EP | 0884247 | B1 | 12/1998 |
| EP | 0894737 | B1 | 2/1999 |
| GB | 1431173 | A | 4/1976 |

* cited by examiner

PACKAGE FOR SMOKING ARTICLES WITH LID FLAP

CLAIM FOR PRIORITY

This application is a National Stage Entry entitled to and hereby claims priority under 35 U.S.C. §§365 and 371 to corresponding PCT Application No. PCT/GB2012/050196, filed Jan. 31, 2012, which in turn claims priority to GB Application No. 1103091.3, filed Feb. 23, 2011. The entire contents of the aforementioned applications are herein expressly incorporated by reference.

DESCRIPTION

The present invention relates to a package for smoking articles. In particular, the invention relates to a hinge-lid package for smoking articles, but is not limited thereto.

Hinge-lid packs are well known to those skilled in the art and are in widespread use in the tobacco industry for holding cigarettes in a crush resistant manner. An example of a hinge-lid pack is shown in GB 1 431 173 and such a pack generally holds ten to twenty individual cigarettes in a predetermined arrangement. Hinge-lid packs are typically produced from a pair of cardboard blanks.

However, a recognised problem of such conventional packs is that they have a tendency not to stay properly closed after the initial opening of the pack, such that the lid is disposed in a partially open position. This problem is sometimes referred to as "yawning" or "smiling". Furthermore, if the pack is held upside down when closed, the lid may open under the weight of the smoking articles inside, and hence the smoking articles may fall out of the pack. It is therefore desirable to provide a hinge-lid pack with improved resistance to opening the lid in order to allow the pack to be closed securely.

In an attempt to overcome the above problem, many existing packs include one or more protruding tabs or ears formed on a container portion of the pack. Such protrusions engage with an inside wall of the lid to assist in frictionally holding the lid closed. However, such protrusions do not 'lock' the lid in a fully closed position and a user is not provided with any tactile indication or feedback that the lid is in a fully closed position. It is therefore desirable to provide a pack which provides an indication to a consumer that the pack is properly closed.

Moreover, it is also known to provide a hinge-lid pack with a flap extending from the container portion of the pack that interlocks with a corresponding shoulder formed on an inner face of the lid. Such a pack produces an audible 'click' noise when the lid is moved into a closed position. Examples of such hinge-lid packs are known from EP 0 894 737 A and EP 0 841 263 A. However, a disadvantage of such packs is that the pack must be manufactured to close tolerance levels, otherwise the flap will not engage with the shoulder and so will not 'lock' the lid, or the flap will engage with the shoulder before the pack is fully closed. In either situation, the lid will not remain in a fully closed position. Furthermore, the audible feedback provided by the flap interlocking with the shoulder may be quiet or missed by a user.

In view of the foregoing, the present invention seeks to provide a package that overcomes or substantially alleviates the problems with conventional hinge-lid packages referred to above.

According to the present invention, there is provided a package for smoking articles comprising a container portion and a lid hingedly connected to the container portion to enclose a space defined by the container portion when the lid is closed, the lid including an end portion and a wall extending from the end portion that overlaps a wall of the container portion when closed, the package further comprising a flap extending from a face of one of said walls having a free end, and a cut-out formed in the other of said walls, wherein one of the cut-out or the free end of the flap has a first edge and a second edge, the first edge being offset from the second edge such that, when the lid is moved to a closed position, said first edge locates over the free end of the flap or the cut-out before the second edge locates over the free end of the flap or the cut-out.

Preferably, the second edge extends parallel to, but spaced from, the first edge.

In one embodiment, the cut-out forms the first edge and the second edge such that, when the lid is moved to a closed position, the free end of the flap locates over the first edge before locating over the second edge.

Conveniently, the first edge is disposed between the second edge and a lower end of said other wall.

Advantageously, the cut-out defines at least one step between an upper level and a lower level of said other wall and the first edge forms an edge of the upper level.

The second edge may form another edge of the upper level.

Advantageously, the cut-out defines a first step between the upper level and an intermediate level, and a second step between the intermediate level and the lower level, wherein the first edge forms an edge of the upper level, and the second edge forms an edge of the intermediate level.

Conveniently, the cut-out comprises a third edge, the third edge forming another edge of the upper or intermediate levels which is offset from said first edge or second edge.

Advantageously, said other wall having the cut-out comprises an inner layer, an outer layer and an intermediate layer, the inner layer being configured to form the upper level and the first step, the intermediate layer being configured to form the intermediate level and the second step and the outer layer being configured to form the lower level.

In another embodiment, the free end of the flap forms the first edge and the second edge such that, when the lid is moved to a closed position, the first edge of the free end of the flap locates over the cut-out before the second edge locates over the cut-out.

The first edge may be disposed between the second edge and a face of the wall from which the flap extends.

In a preferred embodiment, the flap is resiliently deformable such that a free edge of the flap is urged towards the cut-out formed in the other wall.

In one embodiment, the free end of the flap is separated into at least two tab elements which are independently deformable.

Preferably, a first tab element is configured to locate over the first edge and a second tab element is configured to locate over the second edge.

The first edge may formed by a first tab element, and the second edge may be formed by a second tab element.

Advantageously, the flap, the wall extending from the end portion of the lid and/or the container portion wall is deformable and is configured to deform when the lid is moved into an open position so that the flap disengages from the second edge.

Conveniently, the flap extends from container portion and the cut-out is formed in the wall extending from the end portion of the lid.

Preferably, the wall of the lid is a front wall that lies in a plane extending parallel to an axis about which the lid rotates, and the wall of the container portion is a front wall.

According to the present invention, there is also provided a package containing smoking articles.

Preferred embodiments of the present invention will now be described, by way of example only, with reference to the accompanying drawings, in which.

Figure 1:
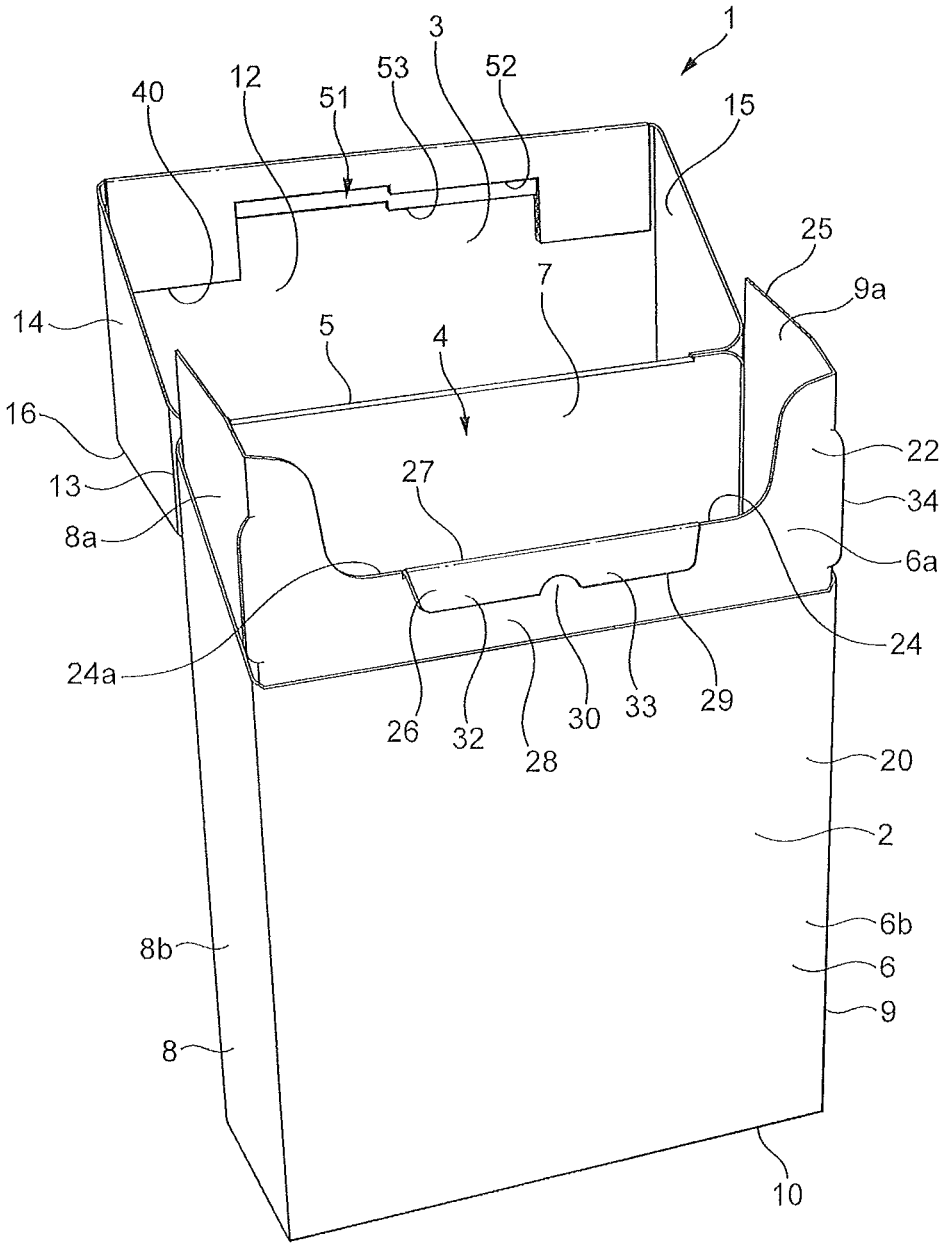
FIG. 1 is a perspective view of a package for smoking articles in accordance with an embodiment of the present invention.
Figure 2:
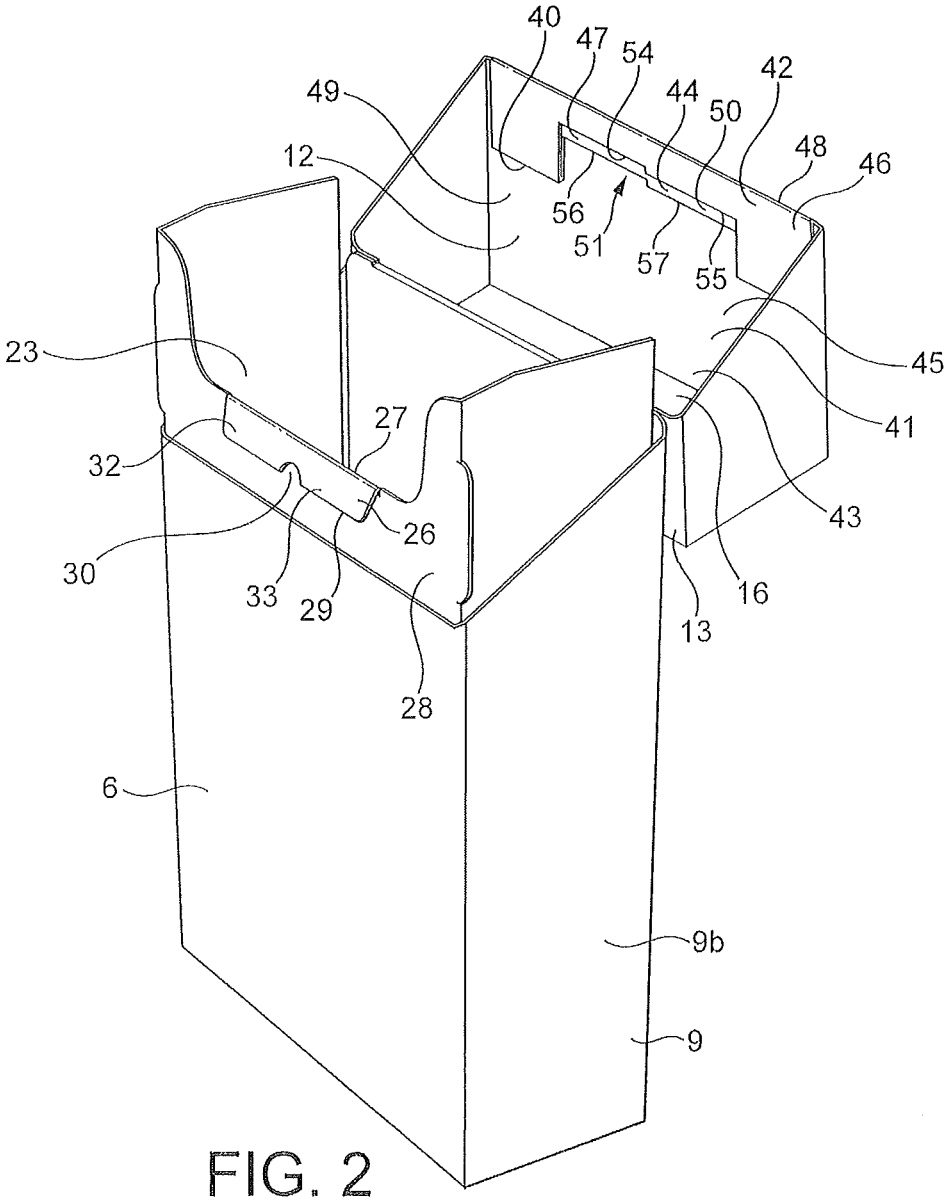
FIG. 2 is another perspective view of the package for smoking articles shown in FIG. 1.

Referring to the drawings, a package for smoking articles 1, also known as a pack, is shown in FIGS. 1 and 2 comprising a container portion 2 and a lid 3.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products but is not limited thereto. The smoking article may be provided with a filter for the gaseous flow drawn by the smoker.

The container portion 2 forms a smoking article receiving space 4 in which smoking articles (not shown) are received, and the lid 3 is hinged to the container portion 2 along a hinge line 5 in order to allow the pack 1 to be opened and closed. It will be appreciated that smoking articles in the smoking article receiving space 4 are accessible when the lid 3 is in an open position (as shown in FIG. 1) and the smoking articles are retained in the smoking article receiving space 4 when the lid 3 is in a closed position.

The container portion 2 comprises container front and back walls 6, 7 which are disposed parallel to but spaced from each other, and two opposing side walls 8, 9 disposed parallel to but spaced from each other and which extend between the container front and back walls 6, 7. A closed end 10 extends from a lower part of the container front, back and side walls 6, 7, 8, 9, and the top of the container portion 2 is opposite the closed end 10 and is covered by the lid 3 when the lid 3 is in its closed position. The hinge line 5 about which the lid 3 is hinged to the container portion 2 is formed along a top end of the container back wall 7.

The lid 3 comprises lid front and back walls 12, 13 which are disposed parallel to but spaced from each other, and two opposing lid side walls 14, 15 disposed parallel to but spaced from each other and which extend between the lid front and back walls 12, 13. An end portion 16 of the lid 3 extends between upper ends of the lid front, back and side walls 12, 13, 14, 15 to close the upper end of the lid 3.

When the lid 3 is in its closed position, the lid front wall 12 overlaps and abuts against the container front wall 6, and the two opposing lid side walls 14, 15 overlap and abut against the two opposing container side walls 8, 9 respectively. The lid back wall 13 aligns with and is attached by the hinge line 5 to the container back wall 7 and the lid end portion 16 is opposite the container closed end 10.

The container front wall 6 includes an inner front wall 6*a* and an outer front wall 6*b*. Similarly, the two container side walls 8, 9 include corresponding inner side walls 8*a*, 9*a* and outer side walls 8*b*, 9*b*. The inner front wall 6*a* and two inner side walls 8*a*, 9*a* extend from and parallel to an upper end of the corresponding outer front wall 6*b* and two outer side walls 8*b*, 9*b*. When the lid 2 is in its closed position, the lid front wall 12 lies substantially adjacent to and overlaps the inner front wall 6*a* of the container front wall 6, and the two lid side walls 14, 15 lie adjacent to and overlap the corresponding inner side walls 8*a*, 9*a* of the container side walls 8, 9.

Figure 3:
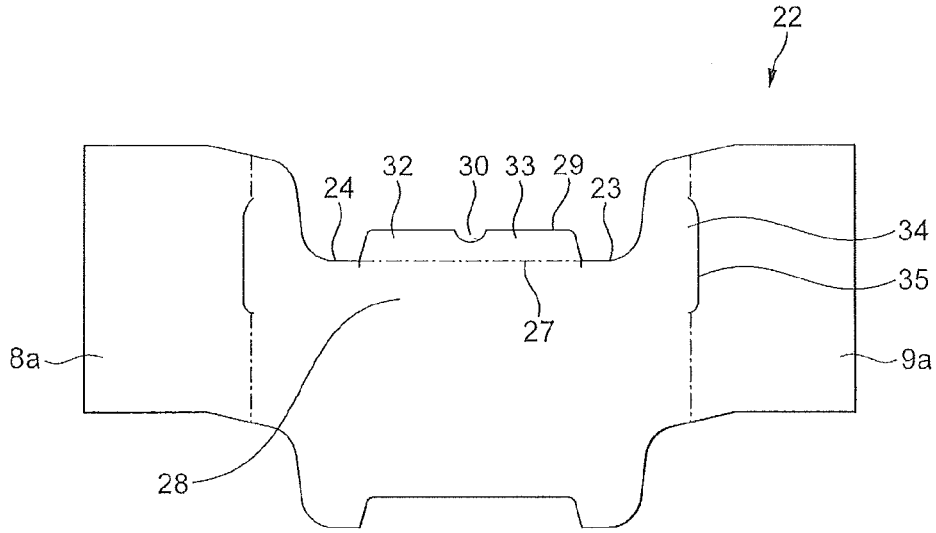
FIG. 3 is a plan view of the blank used to form the outer shell of the package for smoking articles shown in FIG. 1.
Figure 4:
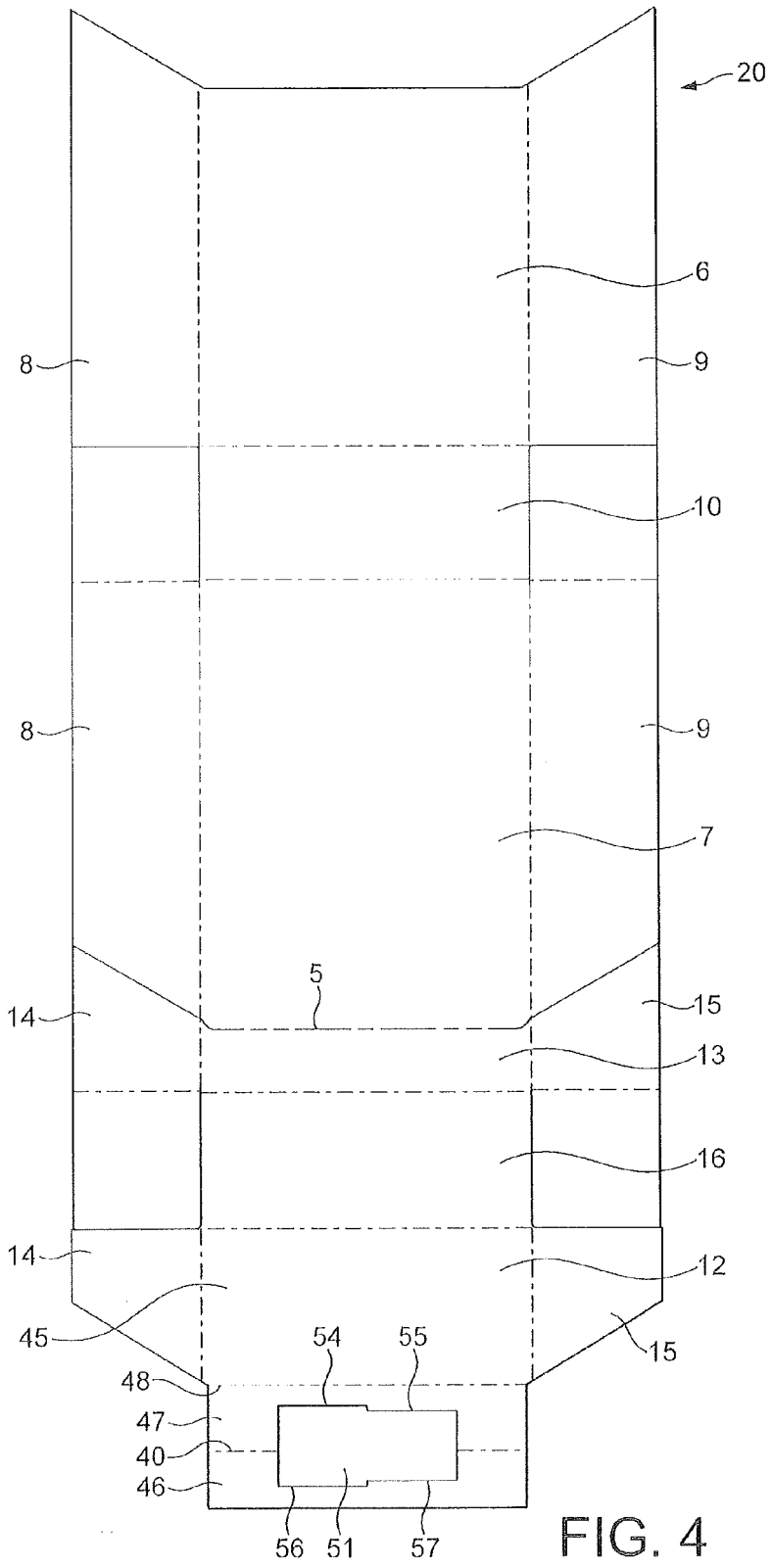
FIG. 4 is a plan view of the blank used to form the inner shell of the package for smoking articles shown in FIG. 1.

In FIGS. 1 and 2, the lid 3 is shown in its open position. In the present embodiment, the pack 1 has an outer frame 20 and an inner frame 22. The outer frame 20 includes the lid 3 and part of the container 2, and the inner frame 22 forms part of the container 2. A blank of the inner frame 22 is shown in FIG. 3, and a blank of the outer frame 20 is shown in FIG. 4. In FIGS. 3 and 4, the dotted lines denote fold lines and the solid lines denote cut-lines. The inner frame 22 forms the inner front wall 6*a* and inner side walls 8*a*, 9*a* of the container front wall 6. The lid 3 therefore fits snugly over the inner frame 22 when the lid is in its closed position.

Although in the present embodiment the pack 1 comprises outer and inner frames 20, 22, it will be appreciated that the invention is not limited thereto and that the pack may be formed from a single frame or multiple frames of various arrangements. For example, the inner front wall of the inner frame may be integrally formed with the outer front wall of the outer frame to form an integral front wall, with the two inner side walls of the inner frame being integrally formed with the two outer side walls of the outer frame to form integral side walls.

The container and lid 2, 3 are formed from a stiff, resilient material, for example a cardboard or plastic, such that the hinge-lid pack retains its shape and so that the contents of the smoking article receiving space 4 are protected.

A recess 23 is formed in an upper part of the inner front wall 6*a* of the container front wall 6, such that a section 24*a* of a top end 24 of the container front wall 6 is below an upper end 25 of the container side walls 8, 9. A flap 26 extends from this section 24*a* of the top end 24 of the container front wall 6. The flap 26 is foldable about a fold line 27 which extends along the top end 24 of the container front wall 6 and is shown in FIG. 1 folded back over the container front wall 6 so that it extends downwardly over an outer face 28 of the container front wall 6.

The flap 26 has a free end 29 spaced from the fold line 27 with a free edge 29*a*. An indent 30 or slit is formed in the flap 26 extending from the free edge 29*a* of the flap 26 to divide an outer part of the flap 26 into two distinct tab elements 32, 33. The indent 30 is shown extending only partially into the flap 26, although it will be appreciated that an indent or slit may extend to the fold line 27 such that the tab elements are independent of each other. The flap 26 is formed from a stiff resilient material, so that it is deformable, and therefore the two tab elements are able to resiliently deform independently of each other. Although the flap 26 extends from the upper end of the container front wall 6 in the present embodiment, it will be appreciated that the arrangement is not limited thereto and that the flap may extend from the outer face 28 of the container front wall 6, spaced from the top end 24. The flap 26 is delimited from the container front wall 6 by the fold line 27. This fold line 27 is configured as a perforation line in order to make it easier for the flap 26 to fold over. In its effective position, the flap 26 is folded over to extend at an acute angle from the outer face 28 of the container front wall 6.

The hinge-lid pack also comprises a pair of ears 34 extending outwardly sideways from the inner side walls 8*a*, 9*a* of the container side walls 8, 9. Each ear 34 extends perpendicular to the container side walls 8, 9 parallel to and from the inner front wall 6*a* of the container front wall 6. Each ear 34 is formed by means of a cut line 35 (refer to FIG. 3) formed in the inner side walls 8*a*, 9*a*.

A shoulder 40 is formed on an inner face 41 of the front wall 12 of the lid 3. The shoulder 40 divides the inner face 41 of the lid front wall 12 into an upper level 42 and a lower level 43. An intermediate level 44 is formed between the upper level 42 and the lower level 43, as will become apparent hereinafter.

The front wall 12 of the lid 3 is formed from an outer layer 45, an inner layer 46 and an intermediate layer 47. The outer, inner and intermediate layers 45, 46, 47 are integrally formed with the inner layer 46 extending from the outer layer 45, distal to the end portion 16 of the lid 3 and being folded about the outer layer 45 to extend adjacent and parallel to an inner surface 49 of the outer layer 45. The fold line between the outer and inner layers 45, 46 defines a lower end 48 of the front wall 12 of the lid 3.

The intermediate layer 47 extends from the inner layer 46 distal to the outer layer 45 and is folded about the inner layer 46 so that the intermediate layer 47 is disposed between the outer and inner layers 45, 46. The outer, inner and intermediate layers 45, 46, 47 are adhered to each other using an adhesive. The inner and intermediate layers 46, 47 extend only partially along the inner surface 49 of the outer layer 45 from the lower end 48 and so a part of the inner surface 49 of the outer layer 45 remains exposed.

A cut-out 51 is formed in the inner face 41 of the lid front wall 12. The cut-out 51 extends from the shoulder 40 and forms a recess in each of the inner and intermediate layers 46, 47. The recess in the inner layer 46 is larger than the recess formed in the intermediate layer 47 such that a section of an inner surface 50 of the intermediate layer 47 is exposed to form the intermediate level 44 of the lid inner face 41.

The exposed inner surfaces of the outer, inner and intermediate layers 45, 46, 47 form the lower level 43, upper level 42 and intermediate level 44 of the lid inner face 41 respectively. The cut-out 51 defines an upper step 52 between the upper level 43 and the intermediate level 44, and a lower step 53 between the intermediate level 44 and the lower level 43.

The upper step 52 has two upper cut-out edges 54, 55 which are offset from each other such that one of the cut-out edges is formed closer to the lower end 48 of the lid front wall 12 than the other cut-out edge. The two upper cut-out edges 54, 55 form edges of the upper level 42 and extend parallel but spaced from each other. Similarly, the lower step 53 has two lower cut-out edges 56, 57 which are offset from each other such that one of the cut-out edges is formed closer to the lower end 48 of the lid front wall 12 than the other. The two lower cut-out edges 56, 57 form edges of the intermediate level 44 and extend parallel but spaced from each other.

The upper and lower steps 52, 53 extend parallel to each other, however the lower step 53 is offset from the upper step 52 such that the upper cut-out edges 54, 55 and lower cut-out edges 55, 56 are spaced from each other.

The flap 26 extends from the container front wall 6 such that it is aligned and locates against the upper and lower steps 52, 53 of the cut-out as the lid 3 is moved into its closed position. Each of the two tab elements 32, 33 of the flap 26 is aligned to locate over one of the respective upper cut-out edges 54, 55 and one of the respective lower cut-out edges 56, 57 as the lid 3 is moved into its closed position. The flap 26 and the cut-out 51 together form a locking mechanism to retain the lid 3 in its closed position.

Operation of the hinge-lid package according to the above exemplary embodiment will now be described with reference to FIGS. 1 and 2. When the hinge lid-pack 1 is assembled as described above, smoking articles (not shown) are disposed in the smoking article receiving space 4 of the pack. The lid 3 is then hingedly rotatable to open and close the container portion 2 such that the smoking articles (not shown) are accessible to a user when the lid 3 is in its open position and are retained in the pack when the lid 3 is in its closed position.

As the lid 3 is rotated from its open position to its closed position, the lid front and side walls 12, 14, 15 overlap the container front and side walls 6, 8, 9. The flap 26 is initially in its effective, neutral position, in which it extends at an acute angle to the outer face 28 of the container front wall 6. As the lid 3 is rotated into its closed position, the free edge 29*a* of the flap 26 is brought into contact with the inner face 41 of the lid front wall 12. The flap 26 is urged against the inner face 41 due to the resilience of the flap 26 and/or the front wall 6 of the container portion 2. The free edge 29*a* of the flap 26 initially contacts the upper level 42 and slides therealong as the lid 2 is closed.

The free edge 29*a* of the flap 26 slides along the upper level 42 of the lid front wall inner face 41 until one of the flap tab elements 32 locates over the corresponding upper cut-out edge 54 of the cut-out upper step 52 closest to the lower end 48 of the lid front wall 12. This first tab element 32 is released as it locates over this upper cut-out edge 54, and is resiliently urged towards and impacts against the intermediate level 44 of the upper face 41. An audible click is therefore generated as the section of the free edge 29*a* of the flap 26 defined by this first tab element 32 is resiliently deformed towards and contacts the inner surface of the intermediate level 44. The other tab element 33 remains in contact with the upper level 42 as the section of the free edge 29*a* defined by the second tab element 33 has not yet located over the other upper cut-out edge 55, however the first tab element 32 is able to deflect independently of the second tab element 33 due to the indent 30 formed in the flap 26.

As the lid 3 is further moved into its closed position, the second tab element 33 locates over the other upper cut-out edge 55 of the upper step 52. This second tab element 33 is released as it locates over this other upper cut-out edge 55 of the upper step 52, and is resiliently urged towards and impacts against the intermediate level 44 of the upper face 41. A second audible click is therefore generated as the section of the free edge 29*a* of the flap 26 defined by this second tab element 33 is resiliently deformed towards and contacts the inner surface of the intermediate level 44.

The first tab element 32 then locates over the corresponding lower cut-out edge 56 of the lower step 53 as the lid 3 is further moved into its closed position and is resiliently urged to move from the intermediate level 44 to the lower level 43 such that the first tab element 32 impacts against the lower level 43. A third audible click is therefore generated as the section of the free edge 29*a* of the flap 26 defined by this first tab element 32 is resiliently deformed towards and contacts the inner surface of the lower level 43.

Finally, as the lid 3 reaches its closed position, the second tab element 33 locates over the other lower cut-out edge 57 of the lower step 53. This second tab element 33 is released as it locates over this other lower cut-out edge 57 of the lower step 53, and is resiliently urged towards and impacts against the lower level 43 of the upper face 41. A fourth audible click is therefore generated as the section of the free edge 29*a* of the flap 26 defined by this second tab element 33 is resiliently deformed towards and contacts the inner surface of the lower level 43. Therefore, a user is provided with an audible feedback as the lid is closed.

The lid 3 is then in its closed position. The lid 3 is retained in its closed position by the free edge 29*a* of the flap 26 engaging against the lower cut-out edge 57 of the lower step 53. The flap 26 is therefore interlocked with the cut-out 51 and so the lid is prevented from rotating into its open position. The flap 26 is prevented from sliding back along the lid front wall inner face 41 by the free edge 29*a* of the flap 26 being urged against the lower level 43 and abutting the lower step 53.

It will be appreciated that the flap 26 may not locate over one or more of the cut-out edges 54, 55, 56, 57 of the upper and lower steps 52, 53 as the lid 3 is closed if the lid 3 reaches its closed position before the free edge 29*a* of the flap 26 reaches and locates over said one or more cut-out edges 54, 55, 56, 57. However, in this circumstance audible feedback is provided by the free edge 29*a* of the flap 26 locating over the other cut-out edges and the lid 3 is retained in its closed position by the free end 29 of the flap 26 abutting against the cut-out edges of the upper and lower step that the free edge 29*a* of the flap 26 has already located over.

A rotational force is applied to the lid 3 to move the lid 3 from its closed position to its open position so that access to the enclosed smoking article space 12 is available. The flap 26 is prevented from sliding back along the lid front wall inner face 41 by the free cut-out edge 29 of the flap 26 being urged against the lower level 43 and abutting the lower step 53. Therefore, as the lid 3 is urged to rotate, the lower step 53 acts on the free edge 29*a* of the flap 26 and urges the flap 26 to rotate about its fold line 27. The front wall 12 of the lid 3, the front wall 6 of the container portion 2 and/or the flap 26 are resiliently deformable so that the flap 26 is able to rotate and the lid 3 is able to be moved into its open position. As the lid 3 is moved into its open position the flap 26 is released from the lower step 53 and returns to its neutral position extending at an acute angle from the outer face 28 of the container front wall 6.

Although in the above embodiment the cut-out 51 comprises two steps, an upper step 52 and a lower step 53, each with two cut-out edges 54, 55, 56, 57 which are offset from each other, and a flap with two tab elements 32, 33 that co-operate with the corresponding cut-out edges of the steps, it will be appreciated that alternative arrangements are possible. In particular, it will be appreciated that a cut-out with a single step having two or more cut-out edges offset from each other may be used with a flap with corresponding flap elements, or two or more steps, each step having a single cut-out edge, may be used with a flap having a single tab element. It will also be appreciated that the number of audible 'click' noises produced is dependent on the number of offset edges formed.

Figure 5:
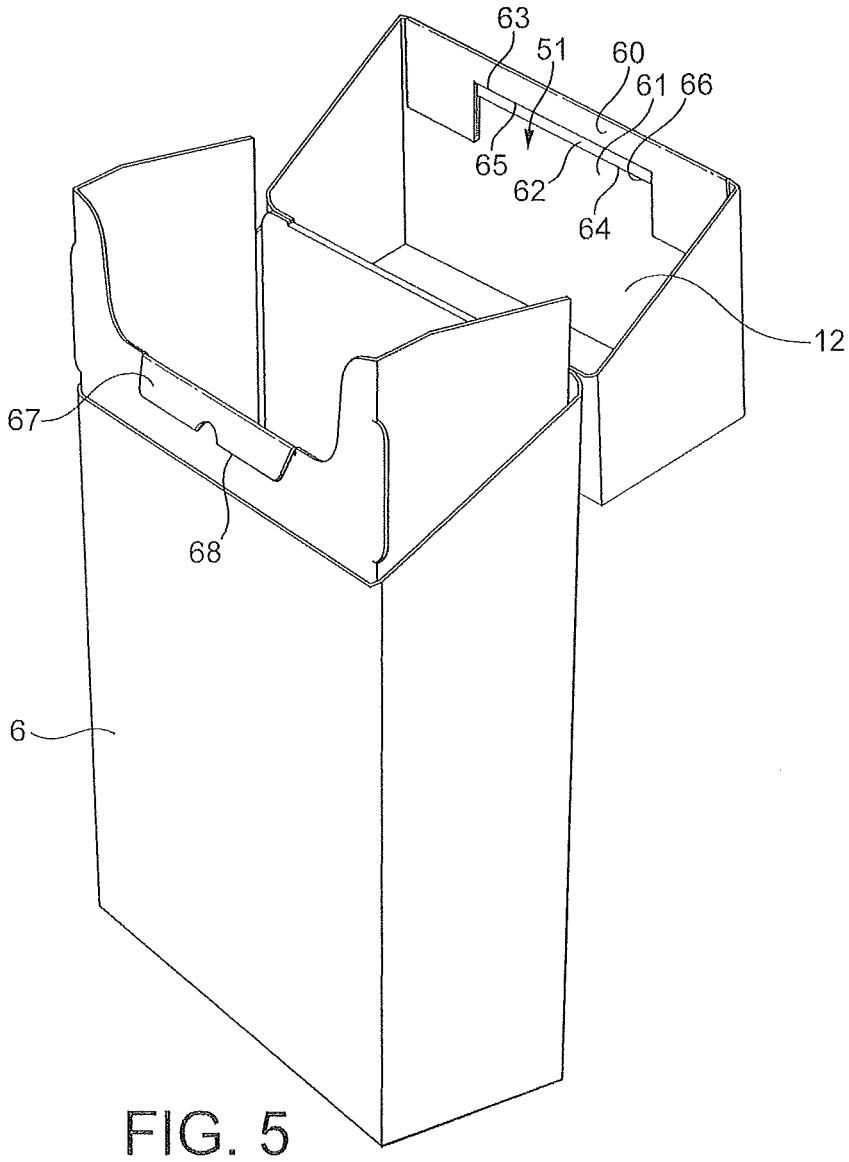
FIG. 5 is a perspective view of a package for smoking articles in accordance with another embodiment of the present invention.

For example, another exemplary embodiment is shown in FIG. 5. The arrangement of the package for smoking articles is generally the same as the arrangement described in the above exemplary embodiment, and so a further detailed description will be omitted herein. Furthermore, components and features corresponding to components and features described in the foregoing embodiment will retain the same reference numerals.

In this embodiment the cut-out 51 formed in the lid 3 has an upper level 60, a lower level 61 and an intermediate level 62, such that an upper step 63 is formed between the upper and intermediate levels 60, 62, and a lower step 64 is formed between the intermediate and lower levels 62, 61. However, in this embodiment each of the upper and lower steps 63, 64 only have one cut-out edge 65, 66 respectively. Furthermore, a flap 67 does not have an indent and so the flap 67 forms a single tab element with a free edge 68. Therefore, when the lid 3 is moved from its open position to its closed position the free edge 68 of the flap 67 locates over the cut-out edge 65 of the upper step 63 to produce a first audible noise, before locating over the cut-out edge 66 of the lower step 64 to produce a second audible noise.

Figure 6:
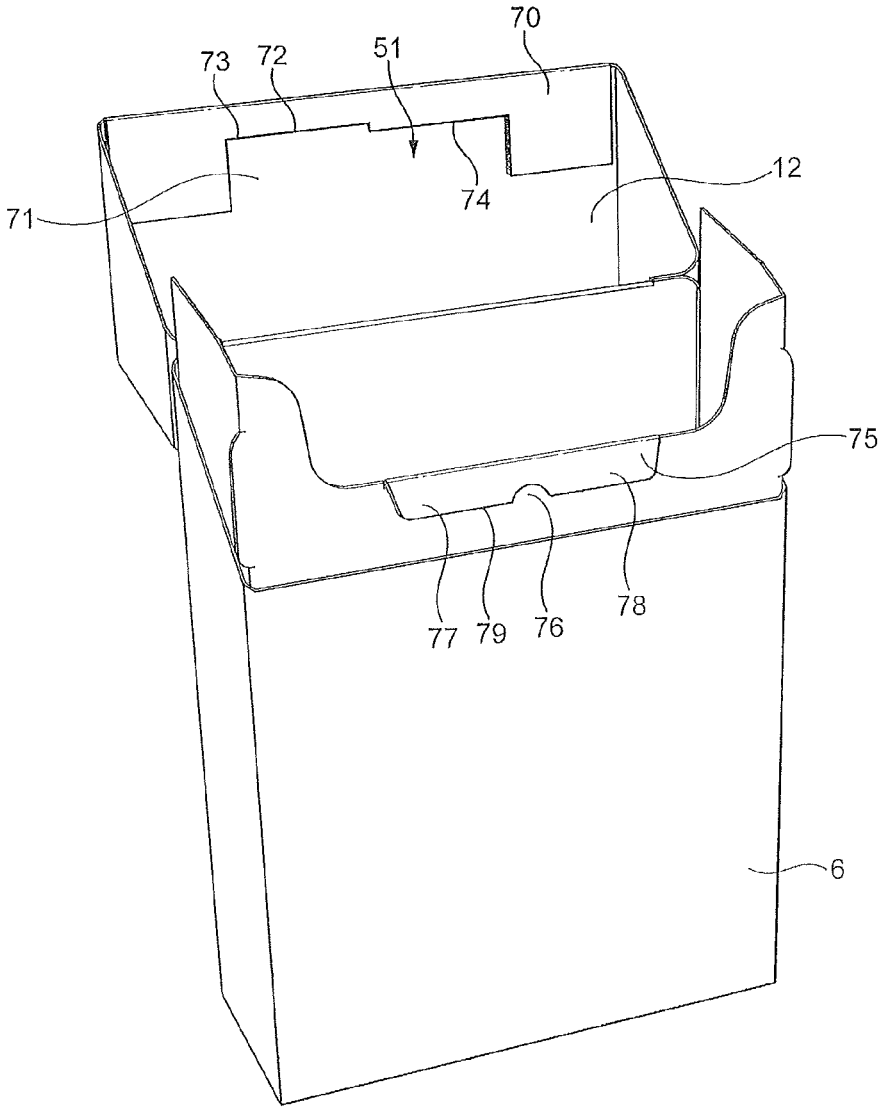
FIG. 6 is a perspective view of a package for smoking articles in accordance with a further embodiment of the present invention.

A further exemplary embodiment is shown in FIG. 6. The arrangement of the package for smoking articles is generally the same as the arrangement described in the above exemplary embodiments, and so a further detailed description will be omitted herein. Furthermore, components and features corresponding to components and features described in the foregoing embodiments will retain the same reference numerals.

In this embodiment the cut-out 51 formed in the lid 3 has two levels, an upper level 70 and a lower level 71, only. Therefore, a single step 72 is formed between the upper and lower levels 70, 71, and two offset cut-out edges 73, 74 are formed in the single step 72. Furthermore, a flap 75 has an indent 76 or slit and so two tab elements 77, 78 are formed at the free edge 79 of the flap 75. Therefore, when the lid 3 is moved from its open position to its closed position a section of the free edge 79 defined by the first tab element 77 of the flap 75 locates over one cut-out edge 73 of the step 72 to produce a first audible noise, prior to a section of the free edge 79 defined by the second tab element 78 of the flap 75 locating over the other cut-out edge 74 of the step 72 to produce a second audible noise.

Figure 7:
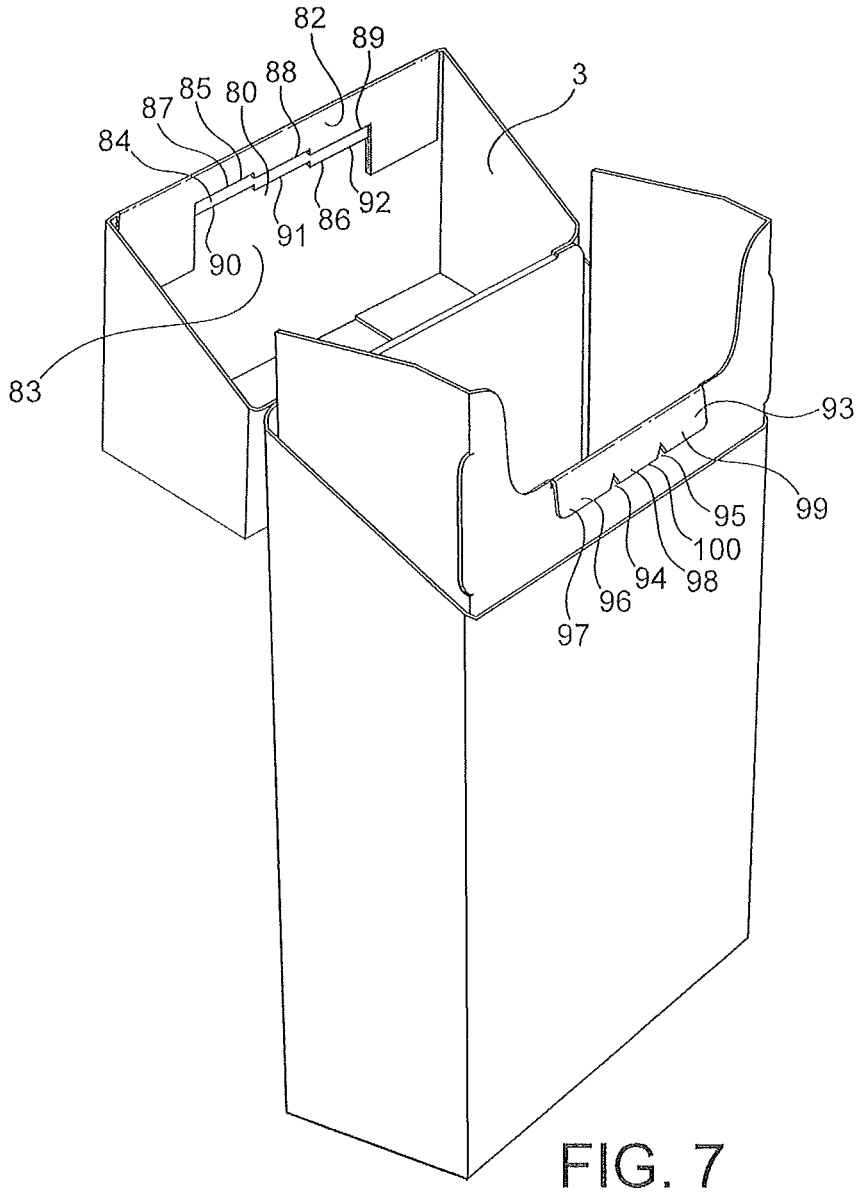
FIG. 7 is a perspective view of a package for smoking articles in accordance with a further embodiment of the present invention.

Referring now to FIG. 7, another exemplary embodiment is shown. The arrangement of the package for smoking articles is generally the same as the arrangement described in the above exemplary embodiments, and so a further detailed description will be omitted herein. Furthermore, components and features corresponding to components and features described in the foregoing embodiments will retain the same reference numerals.

In this embodiment of a package for smoking articles, a cut-out 80 is formed in the lid 3 and has an upper level 82, a lower level 83 and an intermediate level 84, such that an upper step 85 is formed between the upper and intermediate levels 82, 84, and a lower step 86 is formed between the intermediate and lower levels 84, 83. However, in this embodiment three offset cut-out edges 87, 88, 89 are formed in the upper step 85 and three offset cut-out edges 90, 91, 92 are formed in the lower step 86. Each of the three offset cut-out edges 87, 88, 89 formed in the upper step 85 are offset from each other, and each of the three offset cut-out edges 90, 91, 92 formed in the lower step 86 are offset from each other. Furthermore, each of the three offset cut-out edges 87, 88, 89 formed in the upper step 85 extend parallel to and spaced from corresponding offset cut-out edges 90, 91, 92 formed in the lower step 86.

A flap 93 has two indents 94, 95 or slits formed in the flap 93 extending from a free edge 100 of the flap 93, and so three tab elements 97, 98, 99 are formed at a free end 96 of the flap 93. The flap 93 extends from the container front wall 6 such that it is aligned with and locates against the upper and lower steps 85, 86 of the cut-out 80 as the lid 3 is moved into its closed position. Each of the three tab elements 97, 98, 99 of the flap 93 is aligned to locate over one of the respective offset cut-out edges 87, 88, 89 formed in the upper step 85 and one of the respective offset cut-out edges 90, 91, 92 formed in the lower step 86 as the lid 3 is moved into its closed position. The flap 93 and the cut-out 80 together form a locking mechanism to retain the lid 3 in its closed position.

Therefore, when the lid 3 is moved from its open position to its closed position, a section of the free edge 100 defined by the first tab element 97 of the flap 93 locates over a corresponding cut-out edge 87 of the upper step 85 to produce a first audible noise. As the lid 3 is further moved into its closed position a section of the free edge 100 defined by the second tab element 98 locates over a corresponding second cut-out edge 88 of the upper step 85 to produce a second audible noise, prior to a section of the free edge 100 of the flap 93 locating over a corresponding third cut-out edge 89 of the upper step 85 to produce a third audible noise. The free edge 100 of the flap 93 is therefore located against the intermediate level 84. The section of the free edge 100 defined by the first tab element 97 then locates over a corresponding cut-out edge 90 of the lower step 86 to produce a fourth audible noise, followed by the section of the free edge 100 defined by the second tab element 98 locating over a corresponding second cut-out edge 91 of the lower step 86 to produce a fifth audible noise, and then the section of the free edge 100 defined by the third tab element 99 locating over a corresponding third cut-out edge 92 of the lower step 86 to produce a sixth audible noise.

Dependent on the spacing of the lower step 86 from the upper step 85, it will be appreciated that in an alternative embodiment the section of the free edge 100 defined by the first tab element 97 may locate over the corresponding cut-out edge 90 of the lower step 86 to produce an audible noise before the section of the free edge 100 defined by the second and/or third tab elements 98, 99 locates over the corresponding cut-out edges 88, 89 of the upper step 85.

It will be appreciated that if an edge of the upper step is aligned with an cut-out edge of the lower step such that the cut-out edges are equally spaced from a lower end 48 of the front wall 12 of the lid 3, then a single audible click will be generated as two of flap portions simultaneously locate over the two cut-out edges.

Figure 8:
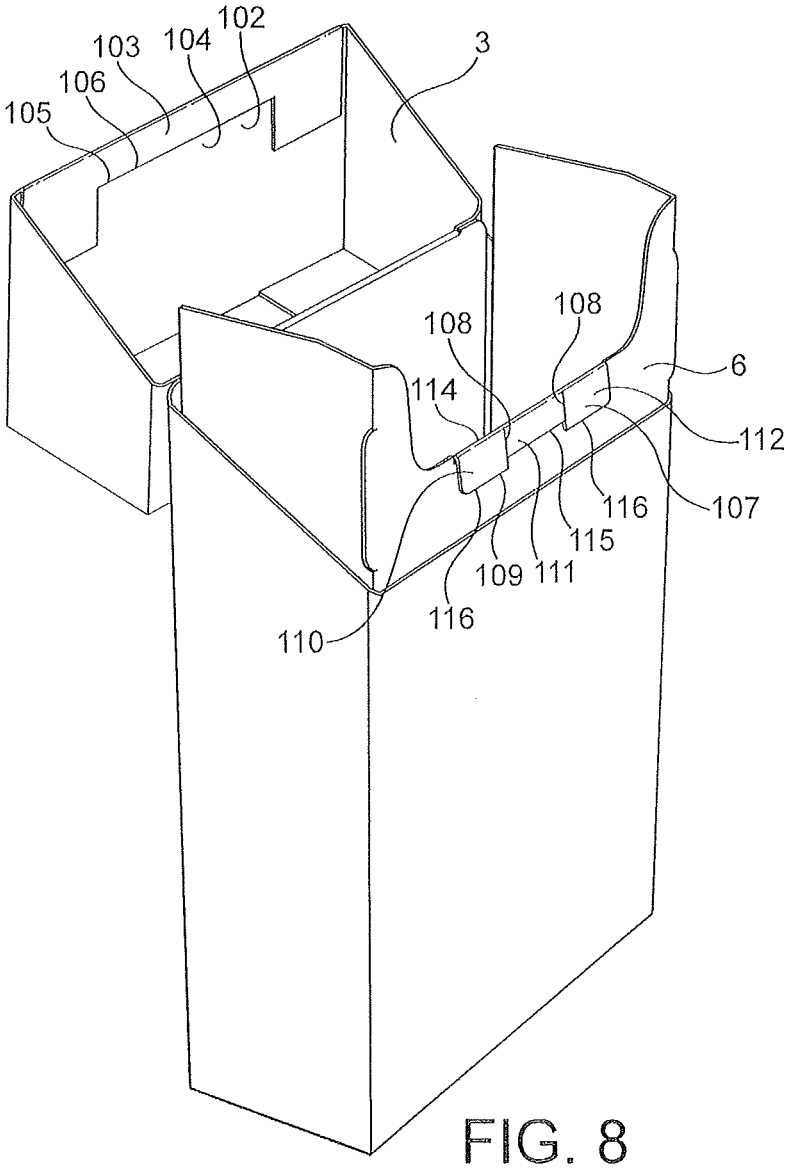
FIG. 8 is a perspective view of a package for smoking articles in accordance with a further embodiment of the present invention.

Referring now to FIG. 8, another exemplary embodiment is shown. The arrangement of the package for smoking articles is generally the same as the arrangement described in the above exemplary embodiments, and so a further detailed description will be omitted herein. Furthermore, components and features corresponding to components and features described in the foregoing embodiments will retain the same reference numerals.

In this embodiment of a package for smoking articles, a cut-out 102 is formed in the lid 3 and has two levels, an upper level 103 and a lower level 104, only. Therefore, a single step 105 is formed between the upper and lower levels 103, 104, having a single cut-out edge 106.

Furthermore, a flap 107 extends from the container front wall 6. The flap 107 has two indents 108 or slits formed in the flap 107 extending from a free edge of the flap 107, and so three tab elements 110, 111, 112 are formed at a free end 109 of the flap 107. In the present embodiment, each indent 108 is a slit which extends to a fold line 114, although it will be appreciated that the indent may extend only partially into the flap 107. The central tab element 111 is abutted on either side by the outer tab elements 110, 112. A central portion of the free edge defined by the central tab element 111 forms a central free edge 115 which is offset from adjacent outer free edges 116 defined by the outer tab elements 110,112. The distance between the fold line 114 and the central free edge 115 is shorter than the distance between the fold line 114 and the outer free edges 116 such that the central free edge 115 is recessed.

The flap 107 extends from the container front wall 6 such that it is aligned with and locates against the step 105 of the cut-out 102 as the lid 3 is moved into its closed position. Each of the three tab elements 110, 111, 112 of the flap 107 is aligned to locate over cut-out edge 106 formed by the step 105 as the lid 3 is moved into its closed position. The flap 107 and the cut-out 103 together form a locking mechanism to retain the lid 3 in its closed position.

When the lid 3 is moved from its open position to its closed position, the central free edge 115 of the central tab element 111 of the flap 107 locates over the cut-out edge 106 of the step 105 to produce a first audible noise. As the lid 3 is further moved into its closed position outer free edges 116 of the outer tab element 110, 112 of the flap 107 locate over the cut-out edge 106 of the step 105 to produce a second audible noise, It will be appreciated that the central free edge 115 locates over the cut-out edge 106 of the step 105 prior to the outer free edges 116 locating over the cut-out edge 106 of the step 105 because the distance between the central free edge 115 and the fold line 114 is shorter than the distance between the outer free edges 116 and the fold line 114. It will also be appreciated that a third audible noise will be produced as the lid 3 is moved into its closed position if the distance between the one of the outer free edge 116 and the fold line 114 is shorter than the distance between the other outer free edge 116 and the fold line 114.

Figure 9:
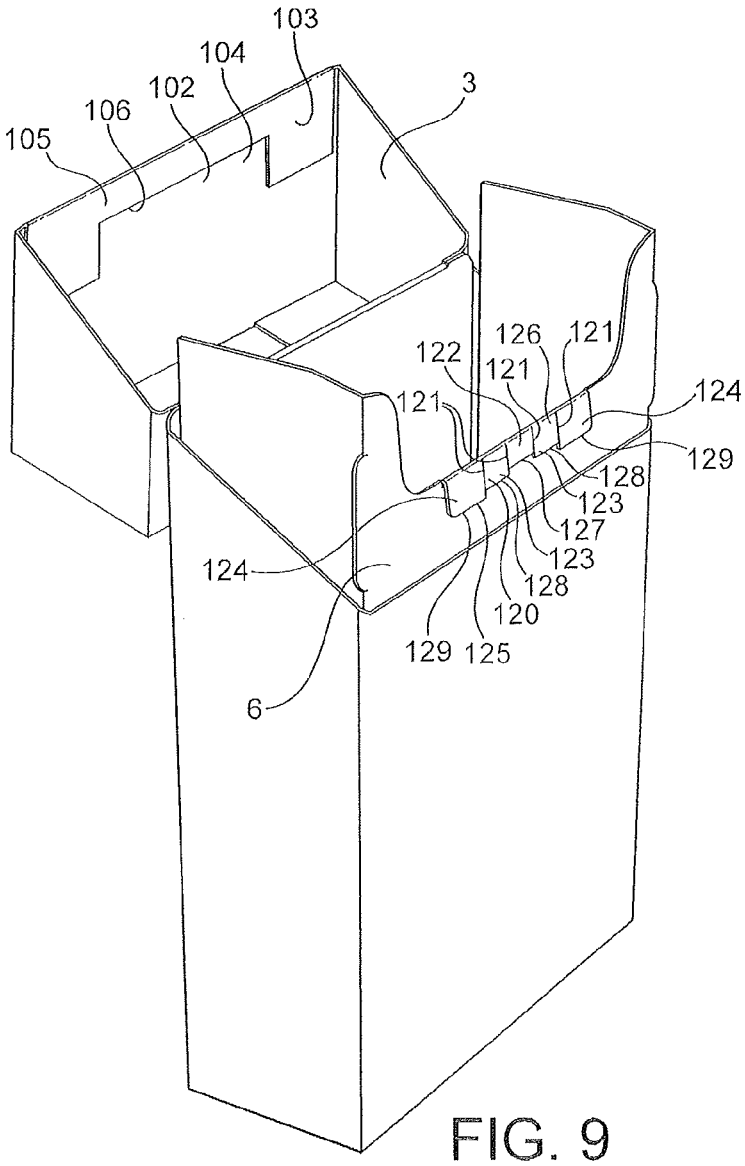
FIG. 9 is a perspective view of a package for smoking articles in accordance with a further embodiment of the present invention.

Moreover, it will be appreciated that the number of audible noises produced may be changed by varying the number and length of the tab elements of the flap. For example, another exemplary embodiment is shown in FIG. 9. The arrangement of the package for smoking articles is generally the same as the arrangement described in the above exemplary embodiment, and so a further detailed description will be omitted herein. Furthermore, components and features corresponding to components and features described in the foregoing embodiment will retain the same reference numerals.

In this embodiment of a package for smoking articles, a cut-out 102 is formed in the lid 3 and has two levels, an upper level 103 and a lower level 104, only. Therefore, a single step 105 is formed between the upper and lower levels 103, 104, having a single cut-out edge 106.

Furthermore, a flap 120 has four indents 121 or slits formed in the flap 120 extending from a free edge of the flap 107, and so five tab elements, namely a central tab element 122, two intermediate tab elements 123, and two outer tab elements 124, are formed at a free end 125 of the flap 107. In the present embodiment, each indent 121 is a slit which extends to a fold line 126, although it will be appreciated that each indent may extend only partially into the flap 120. The central tab element 122 is abutted on either side by the intermediate tab elements 123, and the outer tab elements 124 abut the intermediate tab elements 123 on an opposing side to the central tab element 121. A central free edge 127 defined by the central tab element 122 is offset from adjacent intermediate free edges 128 defined by the intermediate tab elements 123, which are also offset from outer free edges 129 defined by the outer tab elements 124. The distance between the fold line 126 and the central free edge 127 is shorter than the distance between the fold line 126 and the intermediate free edges 128, and the distance between the fold line 126 and the intermediate free edges 128 is shorter than the distance between the fold line 126 and the outer free edges 129.

The flap 120 extends from the container front wall 6 such that it is aligned with and locates against the step 105 of the cut-out 102 as the lid 3 is moved into its closed position. Each of the five tab elements 122, 123, 124 of the flap 120 is aligned to locate over cut-out edge 106 formed by the step 105 as the lid 3 is moved into its closed position. The flap 120 and the cut-out 103 together form a locking mechanism to retain the lid 3 in its closed position.

When the lid 3 is moved from its open position to its closed position, the central free edge 127 of the central tab element 122 of the flap 120 locates over the cut-out edge 106 of the step 105 to produce a first audible noise. As the lid 3 is further moved into its closed position the intermediate free edges 128 of the intermediate tab elements 123 of the flap 120 simultaneously locate over the cut-out edge 106 of the step 105 to produce a second audible noise, prior to the outer free edges 129 of the outer tab elements 124 of the flap 120 simultaneously locating over the cut-out edge 106 of the step 105 to produce a third audible noise It will be appreciated that the central free edge 127 locates over the cut-out edge 106 of the step 105 prior to the intermediate free edges 128 locating over the cut-out edge 106 of the step 105 because the distance between the central free edge 127 and the fold line 114 is shorter than the distance between the intermediate free edges 128 and the fold line 114. Similarly, the intermediate free edges 128 locate over the cut-out edge 106 of the step 105 prior to the outer free edges 129 locating over the cut-out edge 106 of the step 105 because the distance between the intermediate free edges 128 and the fold line 114 is shorter than the distance between the outer free edges 129 and the fold line 114.

It will be appreciated that a flap with a number of tab elements having different lengths may be used in conjunction with a cut-out with more than one edge dependent on the number of audible noises required as the lid is moved into its closed position.

Although in the above described embodiments, the flap and cut-out are formed in the front walls of the container portion and lid respectively, it will be appreciated that the flap may be formed in the lid and the cut-out in the container portion. Furthermore, it will be appreciated that the flap and cut-out may be formed in the side walls of the container portion and lid.

Although in the above embodiments the cut-out is formed in the shoulder, it will be appreciated that the shoulder itself may form one or more of the edges of the cut-out, or may form the cut-out itself. For example, in an embodiment with a cut-out forming a single cut-out edge and the flap having multiple free edges, the shoulder itself may form the edge of the cut-out. Similarly, in an embodiment in which the cut-out has two or more cut-out edges the shoulder may form one or more of the edges of the cut-out.

Although in the above described embodiments the tab elements are separated by an indent or a slit, it will be understood that the tab elements may be spaced from each other along the top end of the container front wall. In such an arrangement the tab elements form separate flap elements that do not locate against each other.

Although embodiments of the invention have been shown and described, it will be appreciated by those skilled in the art that variations may be made to the above exemplary embodiment that lie within the scope of the invention, as defined in the following claims.

The invention claimed is:

1. A package for smoking articles comprising a container portion and a lid hingedly connected to the container portion to enclose a space defined by the container portion when the lid is closed, the lid including an end portion and a wall extending from the end portion that overlaps a wall of the container portion when closed, the package further comprising a flap extending from a face of one of said walls having a free end, and a cut-out formed in the other of said walls, wherein one of the cut-out and the free end of the flap has a first edge and a second edge, the first edge being offset from the second edge such that when the lid is moved to a closed position, said first edge locates over the free end of the flap or the cut-out before the second edge locates over the free end of the flap or the cut-out, the first edge being disposed between the second edge and a free end of one of the wall from which the flap extends and the wall in which the cut-out is formed.

2. The package according to claim 1, wherein the second edge extends parallel to, but spaced from, the first edge.

3. The package according to claim 1, wherein the cut-out forms the first edge and the second edge such that, when the lid is moved to a closed position, the free end of the flap locates over the first edge before locating over the second edge.

4. The package according to claim 3, wherein the cut-out defines at least one step between an upper level and a lower level of said other wall and the first edge forms an edge of the upper level.

5. The package according to claim 4, wherein the second edge forms another edge of the upper level.

6. The package according to claim 4, wherein the cut-out defines a first step between the upper level and an intermediate level, and a second step between the intermediate level and the lower level, wherein the first edge forms an edge of the upper level, and the second edge forms an edge of the intermediate level.

7. The package according to claim 6, wherein the cut-out comprises a third edge, the third edge forming another edge of one of the upper and intermediate levels which is offset from one of said first edge and said second edge.

8. The package according to claim 7, wherein said other wall having the cut-out comprises an inner layer, an outer layer and an intermediate layer, the inner layer being configured to form the upper level and the first step, the intermediate layer being configured to form the intermediate level and the second step and the outer layer being configured to form the lower level.

9. The package according to claim 1, wherein the free end of the flap forms the first edge and the second edge such that, when the lid is moved to a closed position, the first edge of the free end of the flap locates over the cut-out before the second edge locates over the cut-out.

10. The package according to claim 9, wherein the first edge is disposed between the second edge and a face of the wall from which the flap extends.

11. The package according to claim 1, wherein the free end of the flap is separated into at least two tab elements which are independently deformable from each other.

12. The package according to claim 1, wherein the cut-out forms the first edge and the second edge such that, when the lid is moved to a closed position, the free end of the flap locates over the first edge before locating over the second edge;

wherein the free end of the flap is separated into at least two tab elements which are independently deformable from each other; and wherein a first tab element is configured to locate over the first edge-and a second tab element is configured to locate over the second edge.

13. The package according to claim 1, wherein the free end of the flap forms the first edge and the second edge such that, when the lid is moved to a closed position, the first edge of the free end of the flap locates over the cut-out before the second edge locates over the cut-out;

wherein the free end of the flap is separated into at least two tab elements which are independently deformable from each other; and wherein the first edge is formed by a first tab element, and the second edge is formed by a second tab element.

14. The package according to claim 1, wherein at least one of the flap, the wall extending from the end portion of the lid, and the container portion wall is deformable and is configured to deform when the lid is moved into an open position so that the flap disengages from the second edge.

15. The package according to claim 1, wherein the cut-out forms the first edge and the second edge such that, when the lid is moved to a closed position, the free end of the flap locates over the first edge before locating over the second edge;

wherein the first edge is disposed between the second edge and a lower end of said other wall; and wherein the free end of the flap is separated into at least two tab elements which are independently deformable from each other.

16. The package according to claim 1, wherein the cut-out forms the first edge and the second edge such that, when the lid is moved to a closed position, the free end of the flap locates over the first edge before locating over the second edge;

wherein the cut-out defines at least one step between an upper level and a lower level of said other wall and the first edge forms an edge of the upper level; and wherein the free end of the flap is separated into at least two tab elements which are independently deformable from each other.

17. The package according to claim 1, wherein the cut-out forms the first edge and the second edge such that, when the lid is moved to a closed position, the free end of the flap locates over the first edge before locating over the second edge;

wherein the cut-out defines at least one step between an upper level and a lower level of said other wall and the first edge forms an edge of the upper level;

wherein the second edge forms another edge of the upper level; and wherein the free end of the flap is separated into at least two tab elements which are independently deformable from each other.

18. The package according to claim 1, wherein the cut-out forms the first edge and the second edge such that, when the lid is moved to a closed position, the free end of the flap locates over the first edge before locating over the second edge;

wherein the cut-out defines at least one step between an upper level and a lower level of said other wall and the first edge forms an edge of the upper level;

wherein the cut-out defines a first step between the upper level and an intermediate level and the lower level, wherein the first edge forms an edge of the upper level, and the second edge forms an edge of the intermediate level; and wherein the free end of the flap is separated into at least two tab elements which are independently deformable from each other.

19. The package according to claim 1, wherein the first edge is disposed between the second edge and a face of the wall from which the flap extends;

wherein the free end of the flap is separated into at least two tab elements which are independently deformable from each other; and wherein the first edge is formed by a first tab element, and the second edge is formed by a second tab element.

20. A package for smoking articles comprising a container portion and a lid hingedly connected to the container portion to enclose a space defined by the container portion when the lid is closed, the lid including an end portion and a wall extending from the end portion that overlaps a wall of the container portion when closed, the package further comprising a flap extending from a face of one of said walls having a free end, and a cut-out formed in the other of said walls, wherein the cut-out has a first edge and a second edge, the first edge being offset from the second edge such that when the lid is moved to a closed position, the free end of the flap locates over the first edge before locating over the second edge, and wherein the cut-out defines at least one step between an upper level and a lower level of said other wall and the first edge forms an edge of the upper level.

21. A package for smoking articles comprising a container portion and a lid hingedly connected to the container portion to enclose a space defined by the container portion when the lid is closed, the lid including an end portion and a wall extending from the end portion that overlaps a wall of the container portion when closed, the package further comprising a flap extending from a face of one of said walls having a free end, and a cut-out formed in the other of said walls, wherein the cut-out has a first edge and a second edge, the first edge being offset from the second edge such that when the lid is moved to a closed position, the free end of the flap locates over the first edge before locating over the second edge;

wherein the first edge is disposed between the second edge and a lower end of said other wall; and wherein the free end of the flap is separated into at least two tab elements which are independently deformable from each other.

* * * * *